US007686075B2

(12) United States Patent
Stewart et al.

(10) Patent No.: US 7,686,075 B2
(45) Date of Patent: Mar. 30, 2010

(54) DOWNHOLE PUMP ASSEMBLY AND METHOD OF RECOVERING WELL FLUIDS

(75) Inventors: Kenneth Roderick Stewart, Aberdeen (GB); Hector Fillipus Alexander Van Drentham Susman, Aberdeen (GB)

(73) Assignee: Rotech Holdings Limited, Aberdeen (GB)

( * ) Notice: Subject to any disclaimer, the term of this patent is extended or adjusted under 35 U.S.C. 154(b) by 1124 days.

(21) Appl. No.: 10/496,469

(22) PCT Filed: Nov. 25, 2002

(86) PCT No.: PCT/GB02/05284

§ 371 (c)(1),
(2), (4) Date: Aug. 16, 2004

(87) PCT Pub. No.: WO03/046336

PCT Pub. Date: Jun. 5, 2003

(65) Prior Publication Data

US 2005/0011649 A1 Jan. 20, 2005

(30) Foreign Application Priority Data

Nov. 24, 2001 (GB) ..... 0128262.3

(51) Int. Cl.
*E21B 43/00* (2006.01)
*F04B 17/00* (2006.01)

(52) U.S. Cl. ..... 166/106; 166/68; 166/105; 417/405; 415/901; 415/902

(58) Field of Classification Search ..... 166/369, 166/105, 106, 101, 68, 69; 417/375, 405, 417/409, 406; 416/198 A, 198 R; 415/120, 415/901, 902; 175/107
See application file for complete search history.

(56) References Cited

U.S. PATENT DOCUMENTS

| | | | | | |
|---|---|---|---|---|---|
| 1,177,989 | A | * | 4/1916 | Bullock | 415/64 |
| 1,482,702 | A | * | 2/1924 | Scharpenberg | 173/64 |
| 1,811,948 | A | * | 6/1931 | Loomis et al. | 417/91 |
| 2,750,154 | A | * | 6/1956 | Boice | 173/205 |
| 3,171,630 | A | * | 3/1965 | Harney et al. | 415/14 |
| 3,758,238 | A | * | 9/1973 | Erickson et al. | 417/408 |
| 4,407,126 | A | * | 10/1983 | Aplenc | 60/641.4 |
| 4,721,436 | A | | 1/1988 | Lepert | |
| 4,838,758 | A | * | 6/1989 | Sheth | 415/140 |
| 5,033,937 | A | * | 7/1991 | Wilson | 415/170.1 |

(Continued)

FOREIGN PATENT DOCUMENTS

EP 0 811 749 A1 12/1997

(Continued)

*Primary Examiner*—Kenneth Thompson
(74) *Attorney, Agent, or Firm*—Tarolli, Sundheim, Covell & Tummino LLP

(57) ABSTRACT

The present invention relates to a downhole tool. In particular, the present invention relates to a downhole pump assembly, a downhole tool assembly including a downhole pump assembly, a well including a downhole pump assembly and to a method of recovering well fluids. In one embodiment of the invention, there is disclosed a downhole tool assembly (10) for location in a borehole (16) of a well (12), the tool assembly (10) including a downhole pump assembly (18). The pump assembly (18) comprises a turbine (26) coupled to a pump (28), for driving the pump (28) to recover well fluid.

40 Claims, 7 Drawing Sheets

U.S. PATENT DOCUMENTS

| | | | | |
|---|---|---|---|---|
| 5,988,275 | A * | 11/1999 | Brady et al. | 166/105.5 |
| 6,082,452 | A | 7/2000 | Shaw et al. | |
| 6,527,513 | B1 * | 3/2003 | Van Drentham-Susman et al. | 415/202 |
| 6,929,064 | B1 * | 8/2005 | Susman | 166/105 |
| 6,929,444 | B1 * | 8/2005 | Bomski | 415/80 |
| 7,192,244 | B2 * | 3/2007 | Grande et al. | 415/90 |
| 2004/0129427 | A1 * | 7/2004 | Sharp | 166/370 |
| 2005/0135944 | A1 * | 6/2005 | Matic | 417/405 |

FOREIGN PATENT DOCUMENTS

| | | | |
|---|---|---|---|
| GB | 2 097 473 | A | 11/1982 |
| GB | 2 170 531 | A | 8/1986 |
| GB | 2324108 | A * | 10/1998 |
| GB | 2 372 271 | A | 8/2002 |
| WO | WO03031815 | A2 * | 4/2003 |

* cited by examiner

DOWNHOLE PUMP ASSEMBLY AND METHOD OF RECOVERING WELL FLUIDS

BACKGROUND OF THE INVENTION

The present invention relates to a downhole tool. In particular, though not exclusively, the present invention relates to a downhole pump assembly, a downhole tool assembly including a downhole pump assembly, a well including a downhole pump assembly and to a method of recovering well fluids.

FIELD OF INVENTION

In the field of oil and gas well drilling, it is sometimes necessary to employ "artificial lift" techniques to recover reservoir fluids from a well borehole. Currently this may be achieved by using an electrical submersible pump (ESP), which includes a pump driven by an electric motor, which is run into the borehole to recover reservoir fluids to surface through the borehole. The ESP includes power and control cables extending from the surface and electrical connections in the downhole environment. This causes significant problems, in particular because typical reservoir depths may be between 1,000 to 10,000 ft, and the cables must be trailed over this length to surface. Also, the electric motor, power cable and electrical connections are typically associated with the highest causes of failure in ESP's. Further equipment including a downhole isolation chamber, surface switchboard and surface power transformer must also be provided. Typical ESP's also include insulation systems and elastomeric components, which are adversely effected by the extreme pressures and temperatures experienced downhole. These factors all contribute to provide significant disadvantages in the use of ESP's, in particular in terms of their running life and maintenance costs.

It is amongst objects of at least one embodiment of at least one aspect of the present invention to obviate or mitigate at least one of the foregoing disadvantages.

SUMMARY OF INVENTION

According to a first aspect of the present invention, there is provided a downhole pump assembly comprising a turbine coupled to a pump, for driving the pump.

The pump assembly may be for driving the pump to recover well fluid. The well fluid is recovered to surface, and may take the form of hydrocarbon bearing reservoir fluid such as oils. Typically, the downhole pump assembly is for location in a casing/lining in a borehole of a well, and the pump assembly may be for coupling to downhole tubing for location in the borehole.

Preferably, at least part of the pump is isolated from at least part or the turbine. The pump may include a pump fluid inlet and a pump fluid outlet, and the pump inlet may be fluidly isolated from at least part of the turbine. In particular, the pump fluid inlet may be fluidly isolated from a fluid outlet of the turbine. In this fashion, the pump may be activated to pump and thus recover mainly well fluid. However, turbine drive fluid (such as water or steam, where the well fluids comprise very thick or viscous oils) may be carried with the well fluid; the pump fluid outlet may be disposed in fluid communication with the turbine outlet, for mixing of the well and turbine drive fluids for recovery. Alternatively, the turbine fluid outlet may also be isolated from the pump fluid outlet, and the turbine fluid outlet may be spaced from the pump for discharging turbine drive fluid at a location spaced from the pump. Beneficially, the turbine fluid outlet is located, in use, further downhole than the pump fluid outlet. Advantageously, this allows, in particular, the turbine drive fluid to be injected into the formation, ideally at a location spaced perhaps hundreds or thousands of feet from the pump. This injected fluid helps to maintain formation pressure at acceptable operational levels for recovery of well fluid. This also advantageously isolates the recovered well fluid from turbine drive fluid, limiting the degree of separation otherwise required at surface to obtain the well fluid.

The at least part of the pump may be fluidly isolated from the at least part of the turbine by a packer or other isolation means. The pump may be for location in the packer, such that the packer seals a chamber, in particular an annulus defined between the pump and a borehole in which the downhole pump assembly is located, in particular between the pump assembly and casing/lining in the borehole. The turbine and pump outlets may be disposed above or upstream, with reference to the direction of recovery of well fluid, of the packer or other isolation means, for mixing of the well and turbine drive fluids. Alternatively, the pump assembly may further comprise discharge means in the form of discharge tubing coupled to the pump assembly and defining an outlet forming a fluid outlet of the turbine. This may allow turbine drive fluid to be discharged at the location spaced from the pump. The turbine outlet defined by the discharge means may be isolated from the pump by a packer or other isolation means.

The turbine may be directly coupled to the pump and the turbine and pump may be selected according to desired operating characteristics of one of the pump or turbine, to balance, in particular, ideal operating rotational velocities of the turbine and pump. As will be discussed below, the turbine may be adjustable to vary the rotational velocity of the turbine, for example by varying a size of a nozzle of the turbine, to balance the flow velocity of fluid flowing through the turbine, and thus the rotational velocity of the turbine, to that of the pump. Alternatively, the downhole pump assembly may further comprise gear means such as a gear unit coupling the turbine to the pump. The turbine and pump may include respective bearing assemblies such as one or more thrust bearings, for absorbing axial thrust loading generated by the turbine and the pump, respectively.

The downhole pump assembly may include delivery tubing for supplying drive fluid to the turbine and may also include return tubing for returning well fluid and/or turbine drive fluid to surface. The delivery and return tubing may comprise coil tubing and may be for coupling to downhole tubing such as production tubing extending from surface. The delivery and return tubing may be sealed by a packer or other isolation means. This may serve to isolate a generally annular chamber defined between a borehole in which the downhole pump assembly is located and the assembly itself and/or downhole tubing, to constrain return flow to surface to be directed through the return tubing. Alternatively, the downhole pump assembly may be for coupling directly to downhole tubing for supplying turbine drive fluid and the assembly may be adapted to recover well fluid through an annulus defined between a borehole and the downhole pump assembly and/or downhole tubing. Additionally, where the pump assembly further comprises discharge tubing, the tubing may extend through the turbine and pump or be coupled to and extend therefrom, to a discharge location spaced from the pump assembly.

According to a second aspect of the present invention, there is provided a downhole tool assembly comprising downhole tubing and a downhole pump assembly coupled to the downhole tubing for location in a borehole of a well, the pump assembly including a turbine coupled to a pump, for driving the pump to recover well fluid.

According to a third aspect of the present invention, there is provided a well comprising:

a borehole;

downhole tubing located in the borehole; and a downhole pump assembly coupled to the downhole tubing and located in the borehole in a region of a well fluid producing formation, the pump assembly including a turbine coupled to a pump, for driving the pump to recover well fluid.

The downhole tubing may comprise production tubing extending from surface. The downhole pump assembly may be coupled to the production tubing by delivery tubing for supplying drive fluid to the turbine and return tubing for returning well fluid and/or turbine drive fluid to surface. The delivery and return tubing may comprise coil tubing, which may be banded to the production tubing. The downhole pump assembly may further comprise a packer or other isolation means for constraining return fluid flow to be directed through the return tubing. The packer may seal a generally annular chamber defined between the downhole pump assembly and the borehole, in particular between the turbine delivery tubing and return tubing, and the borehole. The borehole may be lined with casing/lining in a known fashion.

Alternatively, the downhole tubing, which may comprise production tubing, may be coupled directly to the downhole pump assembly. In this fashion, turbine drive fluid may be directed through the production tubing to the turbine, and return flow of recovered well fluid and/or turbine drive fluid may be directed along an annulus defined between the downhole tool assembly and the borehole. Additionally, the pump assembly may further comprise discharge means in the form of discharge tubing coupled to the pump assembly and defining an outlet forming a fluid outlet of the turbine.

Further features of the downhole pump assembly are defined with reference to the first aspect of the present invention.

Preferably, the turbine comprises a tubular casing enclosing a chamber having rotatably mounted therein a rotor comprising at least one turbine wheel blade array with an annular array of angularly distributed blades orientated with drive fluid receiving faces thereof facing generally rearwardly of a forward direction of rotation of the rotor, and a generally axially extending inner drive fluid passage generally radially inwardly of said rotor, said casing having a generally axially extending outer drive fluid passage, one of said inner and outer drive fluid passages constituting a drive fluid supply passage and being provided with at least one outlet nozzle formed and arranged for directing at least one jet of drive fluid onto said blade drive fluid receiving faces of said at least one blade array as said blades traverse said nozzle for imparting rotary drive to said rotor, the other constituting a drive fluid exhaust passage and being provided with at least one exhaust aperture for exhausting drive fluid from said at least one turbine wheel blade array.

Preferably also, the turbine has a plurality, advantageously, a multiplicity, of said turbine wheel means disposed in an array of parallel turbine wheels extending longitudinally along the central rotational axis of the turbine with respective parallel drive fluid supply jets.

In a particularly preferred embodiment, the turbine comprises a tubular casing enclosing a chamber having rotatably mounted therein a rotor having at least two turbine wheel blade arrays each with an annular array of angularly distributed blades orientated with drive fluid receiving faces thereof facing generally rearwardly of a forward direction of rotation of the rotor, and a generally axially extending inner drive fluid passage generally radially inwardly of each said turbine wheel blade array, said casing having a respective generally axially extending outer drive fluid passage associated with each said turbine wheel blade array, one of said inner and outer drive fluid passages constituting a drive fluid supply passage and being provided with at least one outlet nozzle formed and arranged for directing at least one jet of drive fluid onto said blade drive fluid receiving faces as said blades traverse said at least one nozzle for imparting rotary drive to said rotor, the other constituting a drive fluid exhaust passage and being provided with at least one exhaust aperture for exhausting drive fluid from said turbine wheel blade arrays, neighbouring turbine wheel blade arrays being axially spaced apart from each other and provided with drive fluid return flow passages therebetween connecting the exhaust passage of an upstream turbine wheel blade array to the supply passage of a downstream turbine wheel blade array for serial interconnection of said turbine wheel blade arrays.

Instead of, or in addition to providing a said inner or outer drive fluid passage for exhausting of drive fluid from the chamber, there could be provided exhaust apertures in axial end wall means of the chamber, though such an arrangement would generally be less preferred due to the difficulties in manufacture and sealing.

In yet another variant both the drive fluid supply and exhaust passage means could be provided in the casing (i.e. radially outwardly of the rotor) with drive fluid entering the chamber from the supply passage via nozzle means to impact the turbine blade means and drive them forward, and then exhausting from the chamber via outlet apertures angularly spaced from the nozzle means in a downstream direction, into the exhaust passages.

Thus essentially the turbine is of a radial (as opposed to axial) flow nature where motive or turbine drive fluid moves between radially (as opposed to axially) spaced apart positions to drive the turbine blade means. This enables the performance, in terms of torque and power characteristics, of the turbine to be readily varied by simply changing the nozzle size—without at the same time having to redesign and replace all the turbine blades as is generally the case with conventional axial flow turbines when any changes in fluid velocity and/or fluid density are made. Thus, for example, reducing the nozzle size will (assuming constant flow rate) increase the (fluid jet) flow velocity thereby increasing torque This will also increase the operating speed of the turbine and thereby the power, as well as increasing back pressure. Similarly increasing flow rate while keeping nozzle size constant will also increase the (fluid jet) flow velocity thereby increasing torque as well as giving an increase in the operating speed of the turbine and thereby the power and increasing back pressure. Alternatively, increasing the nozzle size while keeping the (fluid jet) flow velocity constant—by increasing the flow rate, would increase torque and power without increasing the turbine speed or back pressure. If desired, torque can also be increased by increasing the density of the drive fluid (assuming constant fluid flow rate and velocity) which increases the flow mass.

It will be appreciated that individual nozzle size can be increased longitudinally and/or angularly of the turbine, and that the number of nozzles for the or each turbine wheel blade array can also be varied.

The turbine blades can also have their axial extent longitudinally of the turbine increased so as to increase the parallel mass flow of motive fluid through the or each turbine wheel array, without suffering the severe losses encountered with conventional multi-stage turbines comprising axially extending arrays of axially driven serially connected turbine blade arrays.

Another advantage of the turbine that may be mentioned is the circumferential fluid velocity distribution over the turbine blades is, due to the generally radial disposition of the said blades, substantially constant and thus very efficient in comparison with an axial turbine where the velocity distribution varies over the length of the blade and thus losses are caused through hydrodynamic miss-match of fluid velocity and circumferential blade velocity.

Another important advantage over conventional turbines for down-hole use is that the motors of the present invention are substantially shorter for a given output power (even when taking into account any gear boxes which may be required for a given practical application). Typically a conventional turbine may have a length of the order of 15 to 20 metres, whilst a comparable turbine of the present invention would have a length of only 2 to 3 metres for a similar output power. This has very considerable benefits such as reduced manufacturing costs, easier handling, and, in particular allows a downhole pump assembly of the present invention having a low overall length to be provided.

Yet another advantage that may be mentioned is that the relatively high overall efficiency of the turbine allows the use of smaller size (diameter) turbines than has previously been possible. With conventional down-hole turbines, the so-called "slot losses" which occur due to drive fluid leakage between the tips of the turbine blades and the casing due to the need for a finite clearance therebetween, become proportionately greater with reduced turbine diameter. In practice this results in a minimum effective diameter for a conventional turbine of the order of around 10 cm. With the increased overall efficiency of the applicant's turbine it becomes practical significantly to reduce the turbine diameter, possibly as low as 3 cm.

In one, preferred, form of the turbine the outer passage means serves to supply the drive fluid to the turbine wheel means via nozzle means, preferably formed and arranged so as to project a drive fluid jet generally tangentially of the turbine wheel means, and the inner passage means serves to exhaust drive fluid from the chamber, with the inner passage means conveniently being formed in a central portion of the rotor. In another form of the turbine the inner passage means is used to supply the drive fluid to blade means mounted on a generally annular turbine wheel means. In this case the nozzle means are generally formed and arranged to project a drive fluid jet more or less radially outwardly, and the blade means drive fluid receiving face will tend to be oriented obliquely of a radial direction so as to provide a forward driving force component as the jet impinges upon said face.

In principle there could be used just a single nozzle means. Generally though there is used a plurality of angularly distributed nozzle means e.g. 2, 3 or 4 at 180°, 120° or 90° intervals, respectively. In the preferred form of the turbine, the nozzle means are preferably formed and arranged to direct drive fluid substantially tangentially relative to the blade means path, but may instead be inclined to a greater or lesser extent radially inwardly or outwardly of a tangential direction e.g. at an angle from +5° (outwardly) to −20' (inwardly), preferably 0° to −10°, relative to the tangential direction—corresponding to from 95 to 70°, preferably 90 to 80°, relative to a radially inward direction.

As noted above the power of the motor may be increased by increasing the motive fluid energy transfer capacity of the turbine, in parallel—e.g. by having larger cross-sectional area and/or more densely angularly distributed nozzles. The driven capacity of the turbine may be increased by inter alia increasing the angular extent of the nozzle means in terms of the size of individual nozzle means around the casing, and/or by increasing the longitudinal extent of the nozzle means in terms of longitudinally extended and/or increased numbers of longitudinally distributed nozzle means. In general though the outlet size of individual nozzle means should be restricted relative to that of the drive fluid supply passage, in generally known and calculable manner, so as to provide a relative high speed jet flow. The jet flow velocity is generally around twice the linear velocity of the turbine (at the fluid jet flow receiving blade portion) (see for example standard text books such as "Fundamentals of Fluid Mechanics" by Bruce R Munson et al published by John Wiley & Sons Inc). Typically, with a 3.125 inch (8 cm) diameter turbine of the invention there would be used a nozzle diameter of the order of from 0.1 to 0.35 inches (0.25 to 0.89 cm).

The size of the blade means including in particular the longitudinal extent of individual blade means and/or the number of longitudinally distributed blade means, will generally be matched to that of the nozzle means. Preferably the blade means and support therefor are formed and arranged so that the unsupported length of blade means between axially successive supports is minimised whereby the possibility of deformation of the blade means by the drive fluid jetting there onto is minimised, and in order that the thickness of the blade means walls may be minimised. The number of angularly distributed individual blade means may also be varied, though the main effect of an increased number is in relation to smoothing the driving force provided by the turbine. Preferably there is used a multiplicity of more or less closely spaced angularly distributed blade means, conveniently at least 6 or 8, advantageously at least 9 or 12 angularly distributed blade means, for example from 12 to 24, conveniently from 15 to 21, angularly distributed blade means.

It will also be appreciated that various forms of blade means may be used. Thus there may be used more or less planar blade means. Preferably though there is used a blade means having a concave drive fluid receiving face, such a blade means being conveniently referred to hereinafter as a bucket means. The bucket means may have various forms of profile, and may have open sides (at each longitudinal end thereof). Conveniently the buckets are of generally part cylindrical channel section profile (which may be formed from cylindrical tubing section). Optimally, however, the bucket should be aerodynamically/hydrodynamically shaped to prevent detachment of the boundary layer and to produce a less turbulent flow through is the turbine blade array and thus reduce parasitic pressure drop across the blade array.

Various forms of blade support means may be used. Thus, for example, the support means may be in the form of a generally annular structure with longitudinally spaced apart portions between which the blade means extend. Alternatively there may be used a central support member, conveniently in the form of a tube providing the inner drive fluid passage means, with exhaust apertures therein through which used drive fluid from the chamber is exhausted, the central support member having radially outwardly projecting and axially spaced apart flanges or fingers across which the blade means are supported. Alternatively the blade means may have root portions connected directly to the central support member.

The turbine may typically have normal running speeds of the order of, for example, from 2000 to 5,000 rpm. However, small pumps may require to run at higher speeds. Whilst the turbine is preferably directly coupled to the pump, the turbine may alternatively be used with gear box means, in order to increase torque. In this case and in general there may be used gear box means providing around, for example, 2:1 or 3:1 speed reduction. There may be used an epicyclic gear box with typically 3 or 4 planet wheels mounted in a rotating cage support used to provide an output drive in the same sense as the input drive to the sun wheel, usually-clockwise, so that the output drive is also clockwise. There may be used a ruggedized gear box means with a substantially sealed boundary lubrication system, advantageously with a pressure equalisation system for minimizing ingress of drilling fluid or other material from the borehole into the gear box interior.

According to a fourth aspect of the present invention, there is provided a method of recovering well fluids, the method comprising the steps of:

coupling a turbine to a pump to form a downhole pump assembly;

coupling the pump assembly to downhole tubing;

running the downhole tubing and downhole pump assembly into a borehole of a well and locating the pump assembly in a region of a well fluid producing formation; and supplying drive fluid downhole to drive the turbine, to in turn drive the pump and recover well fluid from the borehole.

The method may further comprise coupling the pump assembly to production tubing, and may in particular comprise coupling the turbine to the production tubing by turbine delivery fluid tubing, and by return fluid tubing for recovering well fluid and/or turbine drive fluid. The method may further comprise supplying drive fluid through the turbine drive fluid delivery tubing to drive the turbine and in turn drive the pump to recover well fluid through the return tubing. The turbine drive fluid delivery tubing and return fluid tubing may be sealed with respect to the borehole by isolation means such as a packer. This may advantageously constrain well fluid and/or turbine drive fluid to be returned through the return tubing.

Alternatively, the method may further comprise coupling the pump assembly, in particular the turbine, directly to production tubing and supplying drive fluid through the production tubing to drive the turbine. Well fluid may be recovered through an annulus defined between the downhole pump assembly and/or downhole tubing and the borehole.

The method may further comprise isolating an inlet of the pump from an outlet of the turbine, to isolate the pump inlet from turbine drive fluid. The pump inlet may be isolated from the turbine outlet by locating isolation means such as a packer around part of the pump assembly, in particular the pump.

The method may further comprise mixing well fluid with turbine drive fluid discharged from the turbine and returning the well fluid to surface. The well fluid and discharged turbine drive fluid may be mixed at or in the region of an outlet of the pump. Advantageously, this isolates the pump inlet such that the work carried out by the pump is largely to pump well fluids to surface. Alternatively, or additionally, the method may further comprise injecting or discharging spent turbine drive fluid into the formation. This assists in maintaining formation pressure at acceptable levels. This may be achieved by coupling discharge means to the pump assembly, the discharge means defining a turbine outlet, and by isolating the discharge means outlet from the pump, to direct spent drive fluid into the formation. Preferably, the spent turbine drive fluid is injected at a location spaced from the pump assembly; typically this may be hundreds or thousands of feet, to avoid the spent drive fluid being drawn back out of the formation by the pump.

The turbine may be driven at least in part by recovered well fluid. Preferably, the recovered well fluid is separated into at least water and hydrocarbon components including oils, gases and/or condensates. Separated water, oil or a combination of the two may be used as the turbine drive fluid. Alternatively, the turbine may be driven at least in part by a gas, such as air or Nitrogen, steam or a foam such as Nitrogen foam. It will be understood that, where the turbine is driven at least in part by recovered well fluid, it may be necessary, at least initially, to supply a non-well fluid such as seawater or a mud to the turbine and that following well fluid production or increase in well fluid production using the pump assembly, recovered well fluid may be used to drive the turbine.

However, it will also be understood that recovered well fluid may be used to dive the turbine from start-up where there is a sufficient flow of well fluids to begin with.

BRIEF DESCRIPTION OF DRAWINGS

Embodiments of the present invention will now be described, by way of example only, with reference to the accompanying drawings, in which:

FIGS. 9-13 show an alternative turbine forming part of the downhole pump assemblies shown in FIGS. 1 and 2 in which:

FIG. 9 is a longitudinal sectional view corresponding generally to that of FIG. 3;

FIG. 10 is a transverse section taken along line 10-10 of FIG. 9;

FIG. 11 is a transverse section taken along line 11-11 of FIG. 9;

FIG. 12 is a perspective view showing the principal parts of the turbine of FIGS. 9-11 with the outer casing removed; and FIG. 13 is a view corresponding to FIG. 12 but with part of the stator removed to reveal the rotor.

DETAILED DESCRIPTION OF DRAWINGS

Figure 1:
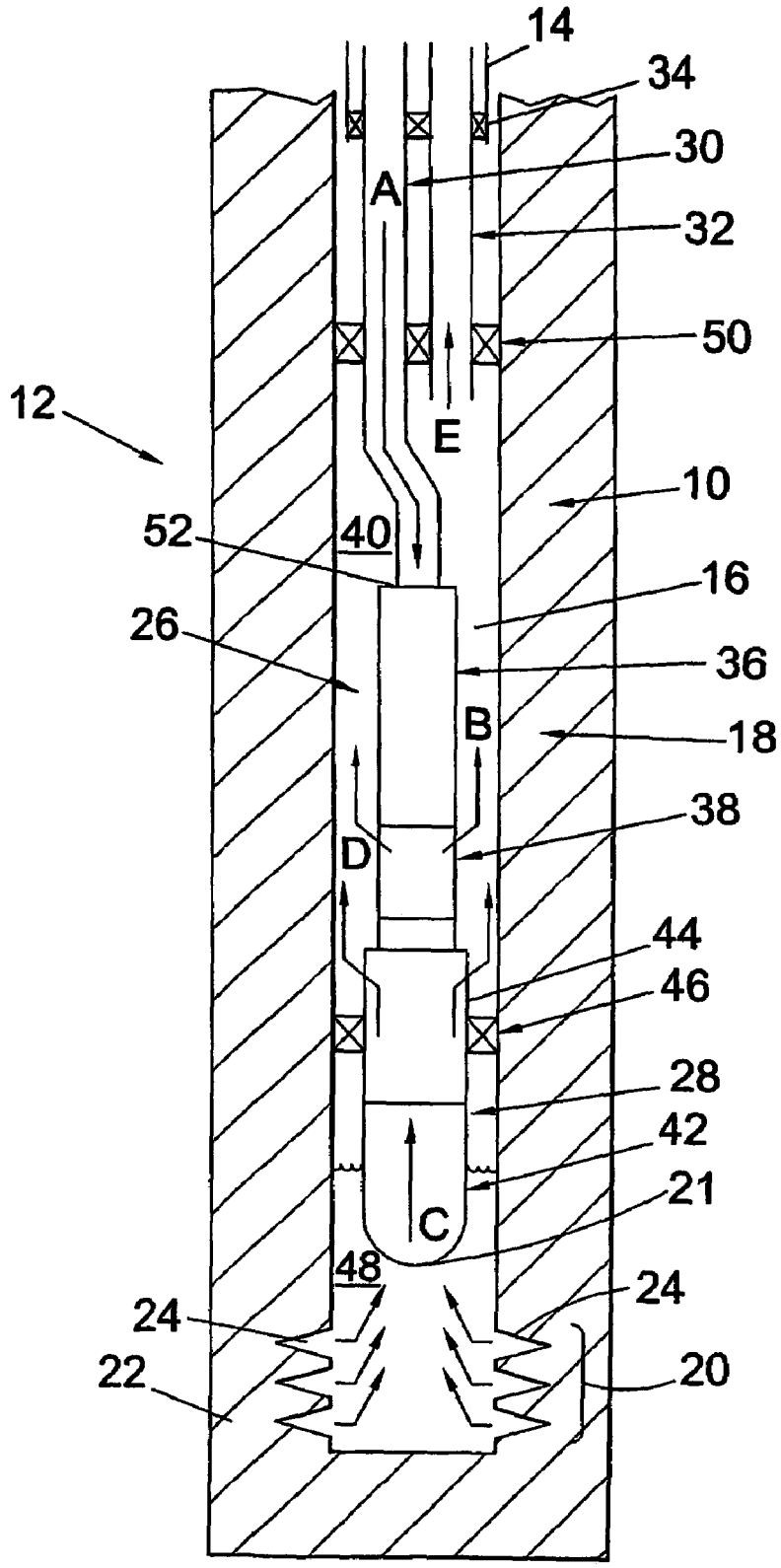
FIG. 1 is a schematic sectional view of a well comprising a downhole tool assembly having a downhole pump assembly, in accordance with an embodiment of the present invention.

Referring firstly to FIG. 1, there is shown a schematic side view of a downhole tool assembly in accordance with an embodiment of the present invention, indicated generally by reference numeral 10, shown located in a well 12.

The downhole tool assembly comprises tubing such as production tubing 14 extending to surface and located in a borehole 16 of the well 12, which has been lined with lining tubing (not shown) in a fashion known in the art. The downhole tool assembly includes a downhole pump assembly 18 coupled to the production tubing 14 and located in the borehole 16 in a region 20 of a well fluid producing formation 22. The formation 22 has been perforated to produce perforations 24 extending into the formation to allow well fluid to flow into the borehole 16, as shown in FIG. 1.

The pump assembly 18 generally includes a turbine 26 coupled to a pump 28, for driving the pump 28 to recover well fluid from the formation 22. In more detail, and viewing FIG. 1 from top to bottom, the downhole pump assembly 18, in particular the turbine 26, is coupled to the production tubing 14 by dedicated turbine drive fluid tubing 30. The turbine drive fluid tubing 30 is provided within the production tubing 14 and extends to surface. Well fluid return tubing 32 is also coupled to the production tubing 14, both tubings 30 and 32 banded at 34 to the production tubing 14. The well fluid return tubing 32 may be provided within the production tubing 14 and extend to surface or may communicate with the production tubing 14 so as to provide a fluid production path to surface. Both the tubings 30 and 32 may comprise coil tubing, for ease of installation.

The production tubing 14 extends within the casing/lining (not shown) to surface, in a known fashion, to an offshore or onshore oil/gas rig. A motor/pump set (not shown) at surface delivers turbine drive fluid (typically seawater in this embodiment) down the production tubing 14 and through the turbine drive fluid tubing 30 to the turbine 26, as indicated by the arrow A in FIG. 1. The turbine 26 includes a turbine unit 36 and a turbine discharge 38, and the turbine drive fluid passes down through the turbine unit 36, to drive the turbine, as will be described with reference to FIGS. 3 to 13. The spent drive fluid is discharged from the turbine unit 36 at the turbine discharge 38, and flows into a generally annular chamber 40 defined between the pump assembly 18 and the walls of the borehole 16, the fluid flowing in the direction of the arrow B shown in FIG. 1.

The turbine drive fluid may comprise seawater, but recovered well fluid may alternatively be used on its own or in combination with another drive fluid, such as seawater. In particular, well fluid recovered to surface may be pumped back down through the turbine drive fluid tubing 30 for driving the turbine. The well fluid may be separated at surface into hydrocarbons (oils, gases and/or condensates) and water, and the recovered water or oil re-injected and used as the drive fluid. In other alternatives, the turbine may be steam driven or gas driven, for example, using air, Nitrogen or a Nitrogen foam.

The pump 28 is coupled to the turbine by a drive shaft (not shown) extending through the turbine discharge 38 and includes a pump unit 42 having a pump discharge 44 forming an outlet of the pump 28. The pump unit 42 comprises a typical pump unit such as those employed in current. ESP assemblies, and includes a pump inlet 21 for drawing fluid into the pump 28, for recovering well fluid to surface. The pump inlet 21 is isolated from the pump outlet in the pump discharge 44, and therefore from the turbine discharge 38, by isolation means in the form of a packer 46. The packer 46 receives, locates and seals the pump 28 in the borehole 16 casing. In this fashion, the pump unit 28 acts mainly to draw well fluid from the formation 22, and does not have to carry out additional work to pump discharged turbine drive fluid through the pump.

When the turbine 26 is activated to drive the pump 28, well fluid 48 is drawn into and through the pump in the direction of the arrow C, discharging from the pump discharge 44 in the direction D, into the chamber 40. The well fluid 48 mixes with discharged turbine drive fluid in the chamber 40, and is pumped up through the well fluid return tube 32 to surface, in the direction of the arrow E. An upper isolation means in the form of a packer 50 seals the tubing 30 and 32, to direct the mixed well fluid and turbine drive fluid into the return tubing 32 and thus to surface, where the well fluid is separated from the turbine drive fluid. As discussed, at least part of the separated turbine drive fluid may be recycled downhole for further driving the turbine 26.

The pump 28 is sized for the flow rate to be drawn from the formation 22 and the pressure head requirement at the depth of the pump assembly 18. Also, the absolute pressure of the drive fluid at the inlet 52 of the turbine 36 is set such that the differential pressure extracted by the turbine 36 from the drive fluid will cause the exhaust pressure from the turbine 36 to be roughly equivalent to the annulus pressure at the depth of the pump assembly 18. Each of the turbine 26 and pump 28 includes respective thrust bearings (not shown), such that axial loads in the turbine and pump are carried by respective self-contained bearings.

Figure 2:
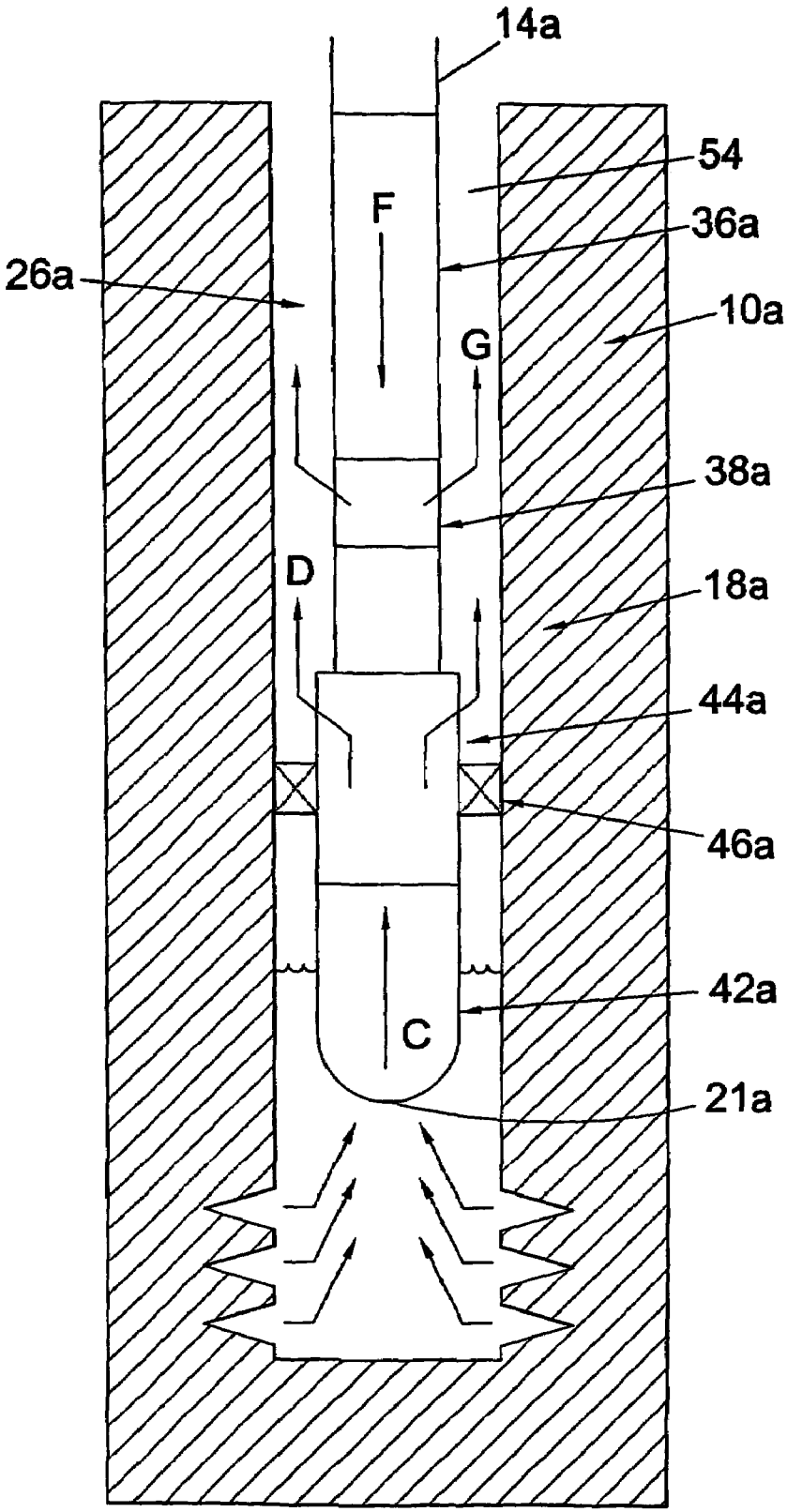
FIG. 2 is a schematic sectional view of a well comprising a downhole tool assembly having a downhole pump assembly, in accordance with an alternative embodiment of the present invention.

Turning now to FIG. 2, there is shown a downhole tool assembly 10*a*. The assembly 10*a* is similar to the assembly 10 of FIG. 1, and like components share the same reference numerals with the addition of the letter "a". For brevity, only the differences between the assembly 10*a* and the assembly 10 will be described.

The turbine 26*a* of the downhole pump assembly 18*a* is coupled directly to production tubing 14*a* such that turbine drive fluid is directed through the production tubing 14*a* into the turbine unit 36*a* in the direction of the arrow F, before discharging from the turbine discharge 38*a* in the direction of the arrow G. In this fashion, reservoir fluid flowing through the pump unit 42*a* in the direction C, and discharging from the pump discharge 44*a* in the direction D, mixes with the discharged turbine drive fluid in the borehole annulus 54, and is returned to surface up the annulus 54. This avoids the costs associated with acquiring and installing the coiled tubing of the turbine drive fluid and well fluid tubings 30, 32 of the assembly 10.

Figure 2A:
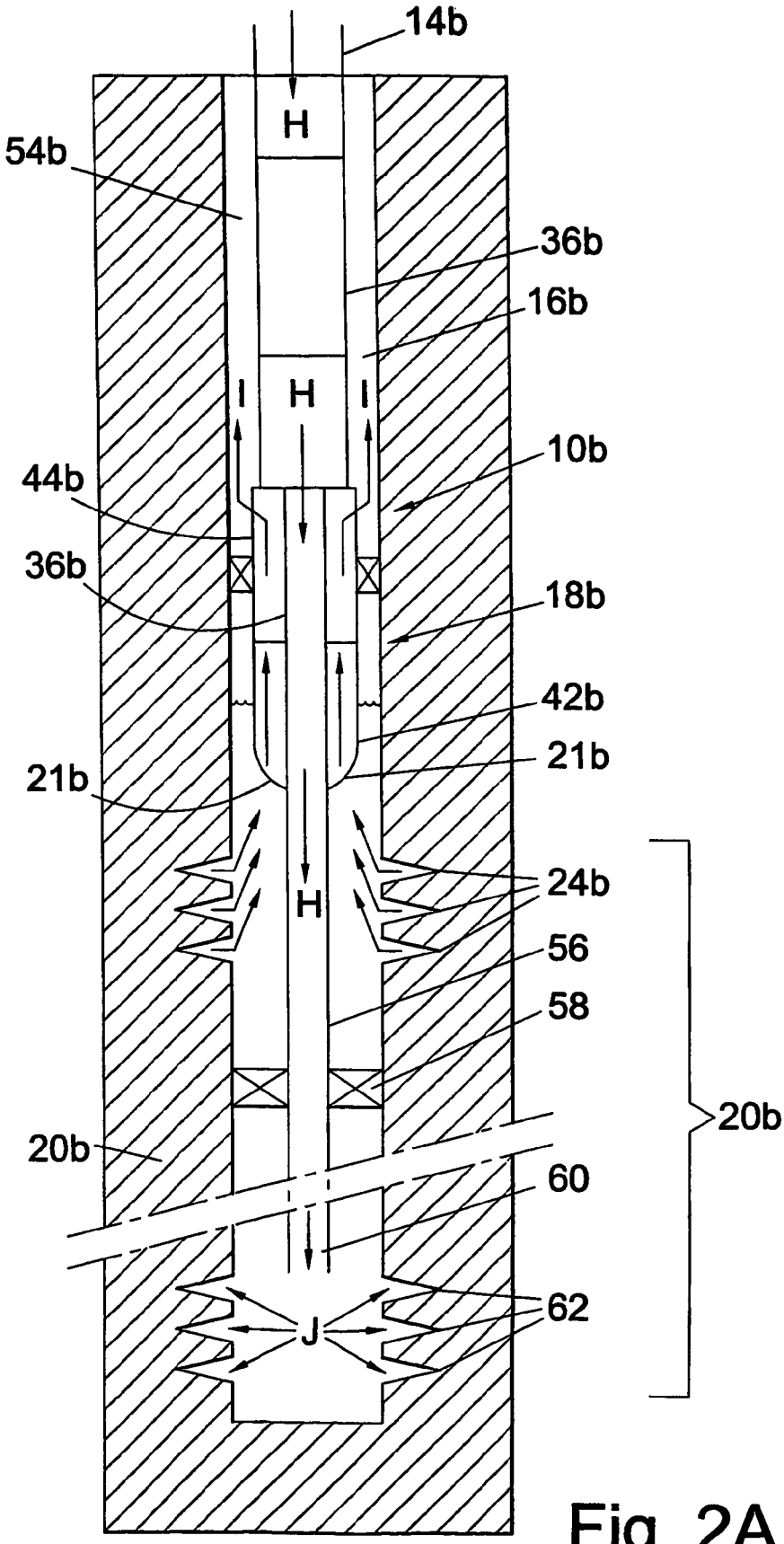
FIG. 2A is a schematic sectional view of a well comprising a downhole tool assembly having a pump assembly, in accordance with a further alternative embodiment of the present invention.

Turning now to FIG. 2A, there is shown a downhole tool assembly 10*b*. The assembly 10*b* is similar to the assemblies 10 and 10*a* of FIGS. 1 and 2, and like components share the same reference numerals with the letter "b". For brevity, only the differences between the assembly 10*b* and the assemblies 10 and 10*a* will be described.

The assembly 10*b* is similar to the assembly 10*a* of FIG. 2A in that the downhole pump assembly 18*b* is coupled directly to production tubing 14*b* such that turbine drive fluid is directed through the Production tubing 14*b* into the turbine unit 36*b*, as shown by the arrow H. However, the pump assembly 18*b* also includes discharge means in the form of a discharge tube 56, which extends from the pump unit 42*b*. The turbine drive fluid flowing down through the turbine 36*b* passes also through the pump unit 42*b*, and the tube 56 isolates the drive fluid from the pump inlet 21*b*.

Isolation means in the form of a lower packer 58 isolates an outlet 60 of the discharge tube 56, which essentially defines an outlet of the turbine 36*b*. The region 20*b* of the production formation extends over a length of the borehole 16*b* and fluid flows from upper perforations 24*b* into the pump inlet 21*b* in the fashion described above. The fluid then exits a pump discharge 44*b* which is provided around or with the turbine 36*b*, and flows up the annulus 54*b* to surface, in the direction of the arrow I.

Spent turbine drive fluid flowing down through the discharge tube 56 exits the outlet 60 and is injected into the formation 20*b* through lower perforations 62. Thus well fluids drawn from the formation 20*b* are replaced by injected, spent turbine drive fluid, as shown by the arrows J in the Figure. This spent fluid is prevented from flowing back up through the borehole 16*b* by the packer 58, and maintains the formation pressure at an acceptable level for well fluids to continue to be withdrawn. Whilst FIG. 2A is a schematic view of the borehole 16*b* and pump assembly 18*b*, it will be understood that the outlet 60 of the discharge tube 56 is spaced at some distance from the pump assembly 18*b* and the perforations 24*b*. This distance may be hundreds or thousands of feet, such that the spent turbine drive fluid is exhausted from the pump assembly 18*b* in a different zone from that where oil is being extracted (the region where the perforations 24*b* are located). This obviates the requirement to separately inject fluid into the well to maintain formation pressure, as may be required with the embodiments of FIGS. 1 and 2. A pressure drop occurs in pumping the spent turbine drive fluid down the discharge tube 56 to the outlet 60 and up the annulus around the discharge tube and the pressure differential across the turbine may therefore be relatively large.

It will also be understood that the assemblies of FIGS. 2 and 2A may be driven using recovered well fluids as described in relation to FIG. 1.

Figure 3:
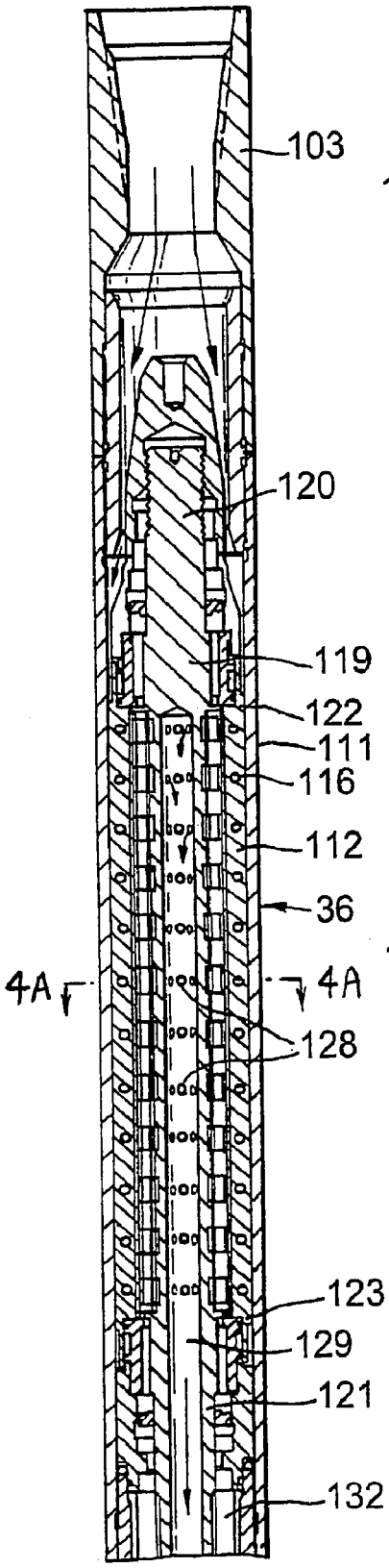
FIG. 3 is an enlarged, detailed view of a turbine power unit forming part of the downhole pump assemblies of FIGS. 1, 2 and 2A, but with bearing and seal details omitted for greater clarity.

Turning now to FIG. 3, the turbine 36 is shown in more detail. Whilst the downhole pump assemblies 18 and 18*a* of FIGS. 1, 2 and 2A include a single turbine unit 36, it will be appreciated that any desired number, for example two or more, turbine units may be provided. Accordingly, as will be described below, FIG. 4B illustrates the connection of the turbine unit 36 to a second such unit 37.

The following description applies to the turbines 26, 26*a* and 26*b* of FIGS. 1 to 2A. However, for clarity, only the turbine 26 is herein described. As shown in FIG. 3, a top connecting sub 103 is coupled to the turbine unit 36, which comprises an outer casing 111 in which is fixedly mounted a stator 112 having a generally lozenge-section outer profile 113 defining with the outer casing 111 two diametrically opposed generally semi-annular drive fluid supply passages 114 therebetween. At the clockwise end 115 of each passage 114 is provided a conduit 116 providing a drive fluid supply nozzle 117 directed generally tangentially of a cylindrical profile chamber 118 defined by the stator 112 inside which is disposed a rotor 119.

Figure 5:
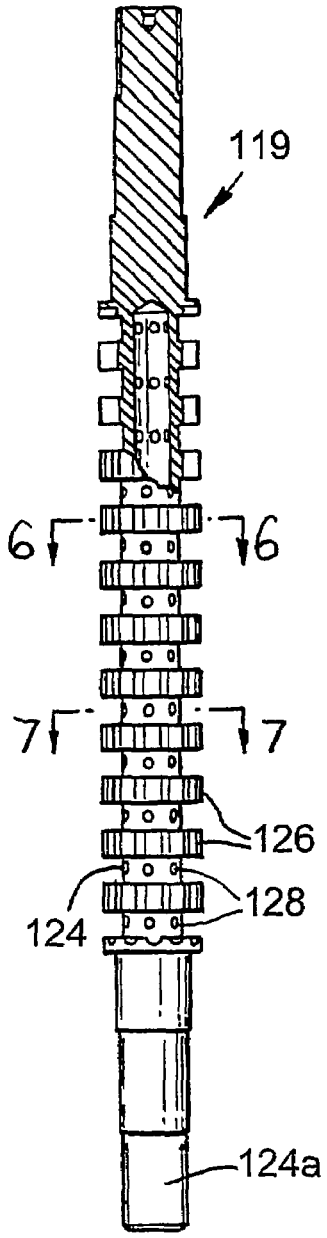
FIG. 5 is a partly sectioned side elevation of the main part of the turbine rotor of FIGS. 3 and 4B without bucket means.
Figure 6:
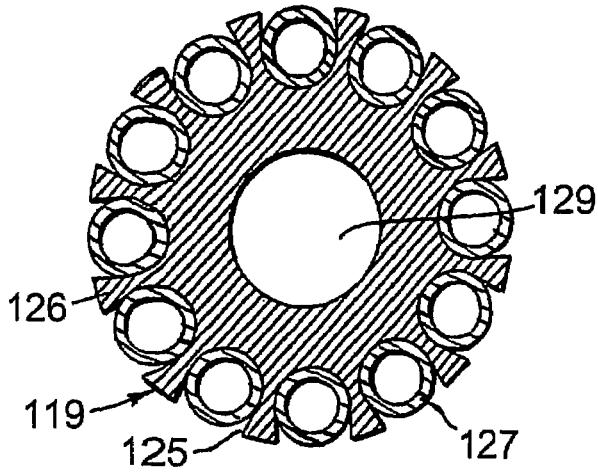
FIG. 6 is a transverse section of the rotor of FIG. 5 with bucket means in place, taken along line 6-6.
Figure 7:
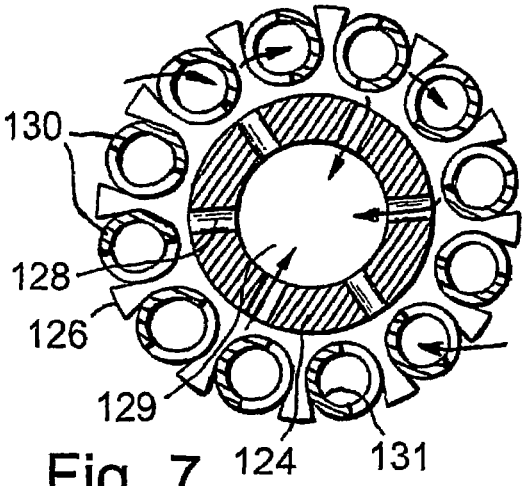
FIG. 7 is a transverse section of the rotor of FIG. 5 with bucket means in place, taken along line 7-7.

The rotor 119 is mounted rotatably via suitable bushings and bearings (not shown) at end portions 120,121 which project outwardly of each end 122,123 of the stator 112. As shown in FIGS. 5 to 7, the rotor 119 comprises a tubular central member 124 which is closed at the upper end portion 120 and, between the end portions 120,121, has a series of spaced apart radially inwardly slotted 125 flanges 126 in which are fixedly mounted cylindrical tubes 127 (see FIGS. 6 & 7) extending longitudinally of the rotor. FIG. 6 is a transverse section through a flange 126 which supports the base and sides of the tubes 127 thereat. FIG. 7 is a transverse section of the rotor 119 between successive flanges 126 and shows a series of angularly spaced exhaust apertures 128 extending radially inwardly through the tubular central member 124 to a central axial drive fluid exhaust passage 129. Between the flanges 126, the tubes 127 are cut-away to provide angularly spaced apart series of semi-circular channel section buckets 130 forming, in effect, a series of turbine wheels 130*a* interspersed by supporting flanges 126. The buckets 130 are oriented so that their concave inner drive fluid receiving faces 131 face anti-clockwise and rearwardly of the normal clockwise direction of rotation of the turbine rotor 119 in use of the turbine. The buckets 130 are disposed substantially clear of the central tubular member 124 so that drive fluid received thereby can flow freely out of the buckets 130 and eventually out of the exhaust apertures 128. With the rotor 119 being enclosed by the stator 112 it will be appreciated that in addition to the "impulse" driving force applied to a bucket 130 directly opposite a nozzle 117 by a jet of drive fluid emerging therefrom, other buckets will also receive a "drag" driving force from the rotating flow of drive fluid around the interior of the chamber 118 before it is exhausted via the exhaust apertures 128 and passage 129.

Figure 4A:
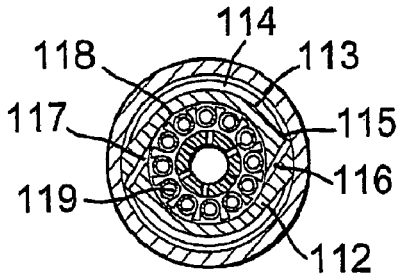
FIG. 4A is a transverse section of the turbine unit of FIG. 3, taken along line 4A-4A.
Figure 4B:
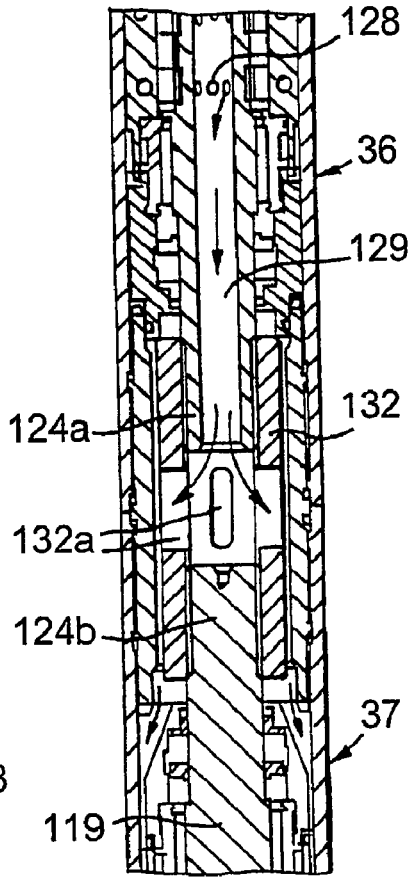
FIG. 4B is a detailed view showing part of a downhole pump assembly similar to that shown in FIGS. 1 and 2, but including a turbine having upper and lower turbine units similar to that shown in FIG. 3, FIG. 4B being a detailed view showing the connection between the upper and lower turbine units.
Figure 8:
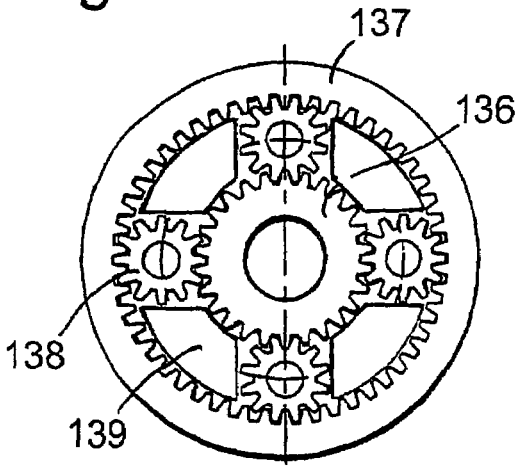
FIG. 8 is a transverse section of an epicyclic gear system, coupled to the turbine of FIG. 3/4B and forming part of a downhole pump assembly in accordance with a further alternative embodiment of the present invention.

As shown in the alternative embodiment of FIG. 4B, which includes two turbine units 36, 37, the rotor 119 of the upper turbine 36 is drivingly connected via a hexagonal (or similar) coupling 132 to the rotor of the lower turbine 37, which is substantially similar to the upper turbine 36. In a still further alternative embodiment, the lower turbine 37 may be in turn drivingly connected via a single or by upper and lower gear boxes (not shown) and suitable couplings to the pump 28. As shown in FIG. 8 the or each gear box may be of epicyclic type with a driven sun wheel 136, a fixed annulus 137, and four planet wheels 138 mounted in a cage 139 which provides an output drive in the same direction as the direction of rotation of the driven sun wheel 136.

In use of the turbine 36, the motive fluid enters the top sub 103 and passes down into the semi-annular supply passages 114 of the upper turbine 36 between the outer casing 111 and stator 112 thereof, whence it is jetted via the nozzles 117 into the chamber 118 in which the rotor 119 is mounted, so as to impact in the buckets 130 thereof. The motive fluid is exhausted out of the chamber 118 via the exhaust apertures 128 down the central exhaust passage 129 inside the central rotor member 124, until it reaches the lower end 124*a* thereof engaged in the hexagonal coupling 32 (where two turbine units 36, 37 are provided), drivingly connecting it to the closed upper end 124*b* of the rotor 119 of the lower turbine 37. Of course, where the turbine 26 includes only the single turbine unit 36, the drive fluid is exhausted from the turbine discharge 38, as shown in FIG. 1. The fluid then passes radially outwards out of apertures 132*a* provided in the hexagonal coupling 132 of the lower turbine and then passes along into the semi-annular supply passages 114 of the lower turbine 37 between the outer casing 111 and stator 112 thereof to drive the lower turbine 37 in the same way as the upper turbine 36. It will be appreciated that the lower turbine is effectively driven in series with the upper turbine. This is though quite effective and efficient given the highly efficient "parallel" driving within each of the upper and lower turbines. The drilling motive fluid exhausted from the lower turbine then passes along central passages extending through the interior of the gear boxes (where provided), discharging at the discharge 0.38.

With a single turbine unit as shown in the drawings suitable for use in a 3.125 inch (8 cm) diameter bottom hole assembly and a drive fluid supply pressure of 70 kg/cm$^2$ there may be obtained an output torque of the order of 2.5 m.kg at 6000 rpm. With a 3:1 ratio gearing down there can then be obtained an output torque of the order of 9 m.kg at 2000 rpm. With a system as illustrated there can be obtained an output torque of the order of 25 m.kg at 600 rpm which is comparable with the performance of a similarly sized conventional Moineau motor or conventional downhole turbine having a diameter of 4¾" (12 cm) and 50 ft (15.24 m) length.

It will be appreciated that various modifications may be made to the above described turbine. Thus for example the profiles of the buckets 130 and their orientation, and the configuration and orientation of the nozzles 117, may all be modified so as to improve the efficiency of the turbine.

The turbine 236 shown in FIGS. 9-13 is generally similar to that of FIGS. 3-8, comprising an outer casing 141 in which is fixedly mounted a stator 142 having a generally lozenge-section outer profile 143 defining with the outer casing 141 four angularly distributed generally segment-shaped drive fluid supply passages 144 therebetween. At the clockwise end 145 of each passage 144 is provided a drive fluid supply conduit 146 providing a drive fluid supply nozzle 147 directed generally tangentially of a cylindrical profile chamber 148 defined by the stator 142 inside which is disposed a rotor 149.

Figure 10:
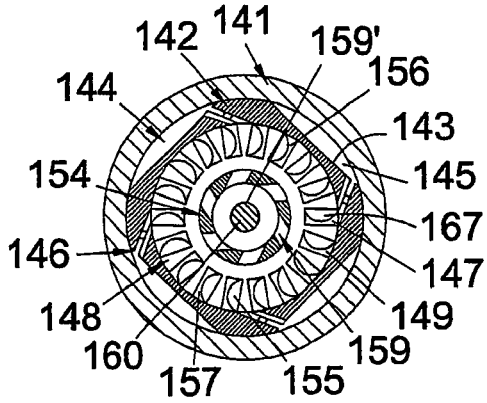
Figure 11:
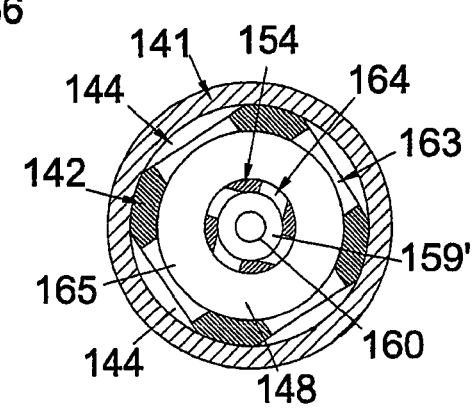
Figure 12:
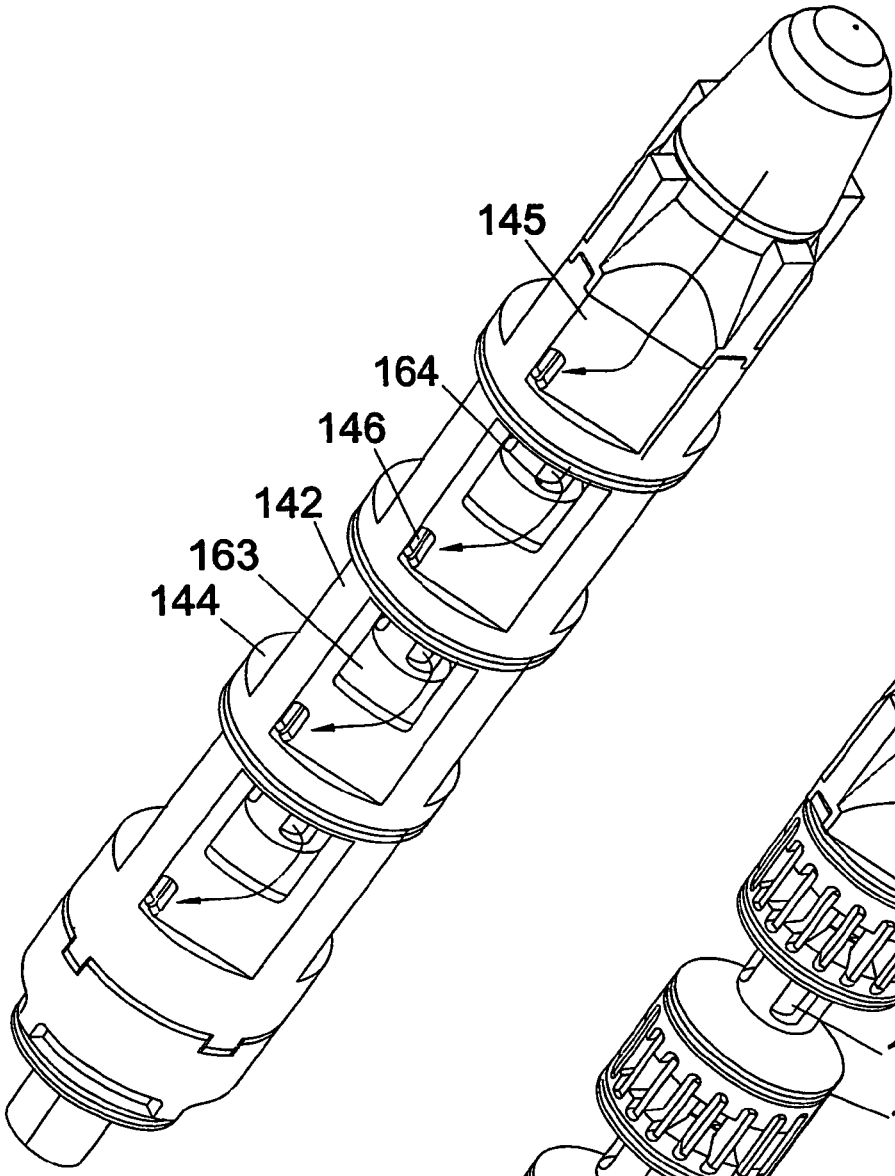
Figure 13:
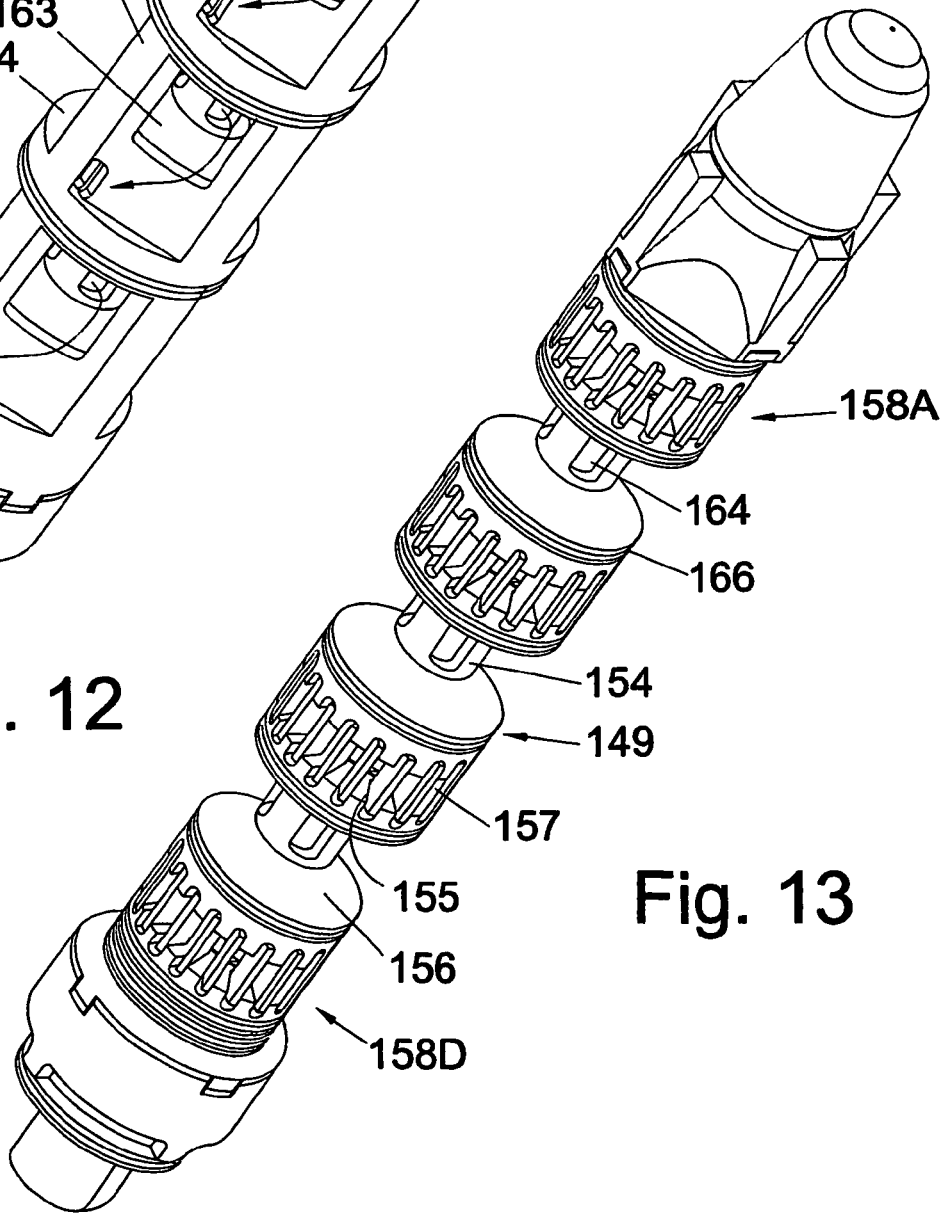

The rotor 149 is mounted rotatably via suitable bushings and bearings 150, 151 at the end portions 152*a*, 152*b* which project outwardly of each end 153*a*, 153*b* of the stator 142. As shown in FIGS. 10, 11 and 12 the rotor 149 comprises an elongate tubular central member 154 which has a series of axially spaced apart radially inwardly slotted 155 flanges 156 in which are fixedly mounted four axially spaced apart sets of cylindrical tube profile or aerodynamically/hydrodynamically shaped turbine blades 157 providing an array of four turbine wheel blade arrays 158A-D extending longitudinally along the central rotational axis of the rotor 149. FIG. 10 is a transverse section through a turbine wheel blade array 158A and shows four nozzles 147 for directing jets of drive fluid into the blades 157 and a series of six angularly spaced apart exhaust apertures 159' extending radially inwardly through the tubular central member 154 to an inner drive fluid exhaust passage 159. Inside the tubular central member 154 is provided a spindle member 160 mounting a series of annular sealing members 161A-C for isolating lengths of inner drive fluid exhaust passage 159' A-C, from each other. A further length of inner drive fluid exhaust passage 159'D is isolated from the preceding length 159'C. by an integrally formed end wall 162.

Between the opposed flanges 156', 156" of each pair of successive turbine wheel blade arrays 158A-D, the stator 142 is provided with relatively large apertures 163 which together with apertures 164 in the tubular central member 154 provide drive fluid return flow passages 165 for conducting drive fluid exhausted from the exhaust apertures 159 of an upstream turbine wheel blade array 158A into the respective inner drive fluid exhaust passage 159', to the drive fluid supply passage 144 of a turbine wheel blade array 158B immediately downstream thereof for serial interconnection of said turbine wheel blade arrays 158A, 158B. As shown in FIG. 11, the apertures 164 in the tubular central member 154 are orientated generally tangentially in order to improve fluid flow efficiency.

As may be seen from the drawings, the drive fluid supply conduits 146 are in the form of relatively large slots having an axial extent almost equal to that of the turbine blades 157 so that the fluid flow capacity and power of each turbine wheel blade array 158A etc is actually similar to that of the or each of the turbine units 36, 37, with its series of 12 turbine wheel blade arrays connected in parallel (as illustrated in FIG. 5) of the above described turbine embodiment. In order to isolate the drive fluid supply passages 144 of successive turbine wheel blade arrays 158A, 158B etc from each other, the flanges 156 supporting the turbine blades 157 are provided with low-friction labyrinth seals 166 around their circumference.

Figure 9:
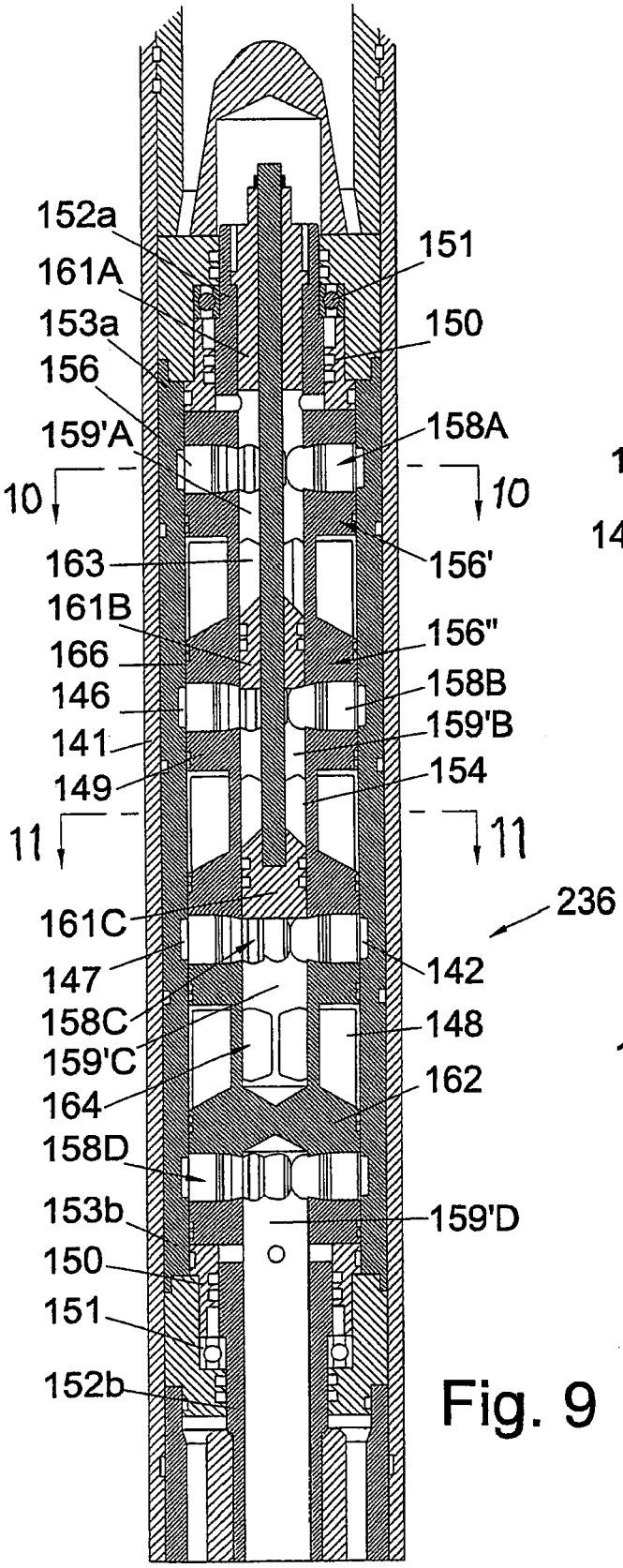

As will be apparent from FIG. 9, the close and compact coupling and arrangement of the four turbine wheel blade arrays 158A-D, requires a much smaller amount of bearings and seals thereby considerably reducing frictional losses as compared with the type of arrangement illustrated in FIGS. 3-5, as well as considerably reduced length, thereby providing a much higher torque and power output for a given length and size of turbine, as compared with previously known turbines.

In other respects the turbine of FIGS. 9-13 is generally similar to that of FIGS. 3-8. Thus the turbine blades 157 form concave buckets 167 oriented so that their concave inner drive fluid receiving faces 168 face anti-clockwise and rearwardly of the normal clockwise direction of rotation of the turbine rotor 149 in use of the turbine drive and fluid received thereby can flow freely out of the buckets 167 and eventually out of the exhaust apertures 159.

In use of the apparatus, the motive/drive fluid enters the top sub 103 and passes down into the supply passage 144 of the first turbine wheel blade array 158A between the outer casing 141 and stator 142 thereof, whence it is jetted via the nozzles 147 into the chamber 148 in which the rotor 149 is mounted so as to impact in the buckets 167 thereof. The motive fluid is exhausted out of the chamber 148 via the exhaust apertures 159 into the central exhaust passage 159' inside the central tubular member 154 whereupon it is returned radially outwardly via the drive fluid return flow passage 165 to the drive fluid supply passage 144 of the next turbine wheel blade array 158B, whereupon the process is repeated.

With a four stage integrated turbine unit as shown in FIGS. 9 to 13 for use in a 3.125 inch (8 cm) diameter bottom hole assembly and a drive fluid mass flow of 110 US gallons per minute (416 litres per minute) and a supply pressure of 1000 psi (70 kg/cm$^2$) there may be obtained an output of 8200 rpm and 17.4 ft-lbs (2.4 m.kg). With a 12:1 ratio gearing down there can be obtained an output torque of 208.4 ft-lbs (28.8 m.kg) at 683 rpm, which is comparable with the performance of a similarly diametrically sized conventional Moineau motor but of twice the length of a conventional downhole turbine of greater diameter and more than four times the length.

Various modifications may be made to the foregoing within the scope of the present invention.

Either one or both of the turbine drive fluid delivery tubing and/or well fluid return tubing may extend to surface.

The invention claimed is:

1. A downhole pump assembly comprising a turbine and a pump, the turbine being coupled to the pump for driving the pump, and wherein the turbine is a radial flow turbine, wherein the turbine includes a fluid outlet isolated from a fluid outlet of the pump, wherein the turbine fluid outlet is spaced from the pump for discharging turbine drive fluid at a location spaced from the pump, and wherein the turbine fluid outlet is located, in use, further downhole than the pump, fluid outlet;

wherein the pump is fluidly isolated from the turbine by a packer, and wherein the pump is adapted to be located in the packer such that the packer seals an annulus defined between the pump and a borehole in which the assembly is located.

2. The downhole pump assembly as claimed in claim 1, wherein, in use, the pump is disposed downhole of the turbine.

3. The downhole pump assembly as claimed in claim 1, wherein the pump is adapted to pump well fluid uphole so as to recover well fluid to surface.

4. The downhole pump assembly as claimed in claim 3, wherein at least part of the pump is isolated from at least part of the turbine.

5. The downhole pump assembly as claimed in claim 3, wherein the pump includes a pump fluid inlet and a pump fluid outlet, and wherein the pump inlet is fluidly isolated from at least part of the turbine.

6. The downhole pump assembly as claimed in claim 5, wherein the pump fluid inlet is fluidly isolated from a fluid outlet of the turbine.

7. The downhole pump assembly as claimed in claim 3, wherein the turbine includes a turbine fluid outlet isolated from a fluid outlet of the pump.

8. The downhole pump assembly as claimed in claim 7, wherein the turbine fluid outlet is spaced from the pump for discharging turbine drive fluid at a location spaced from the pump.

9. A downhole pump assembly comprising a turbine and a pump, the turbine being coupled to the pump for driving the pump, and wherein the turbine is a radial flow turbine, wherein the pump is fluidly isolated from the turbine by a packer, and wherein the pump is adapted to be located in the packer such that the packer seals an annulus defined between the pump and a borehole in which the assembly is located, wherein the turbine and pump include outlets disposed upstream of the packer.

10. The downhole pump assembly as claimed in claim 9, further comprising discharge tubing coupled to the pump assembly and defining an outlet forming a fluid outlet of the turbine.

11. The downhole pump assembly as claimed in claim 9, wherein the turbine is directly coupled to the pump.

12. The downhole pump assembly as claimed in claim 9, wherein the turbine is coupled to the pump for driving the pump to recover well fluid to surface, the downhole pump assembly further comprising a gear unit between the turbine and the pump.

13. The downhole pump assembly as claimed in claim 9, comprising delivery tubing for supplying drive fluid to the turbine and return tubing for returning well fluid to surface.

14. The downhole pump assembly as claimed in claim 13, wherein the delivery and return tubing comprise coiled tubing.

15. The downhole pump assembly as claimed in claim 13, wherein the delivery and return tubing is sealed by isolation means to constrain return flow to surface to be directed through the return tubing.

16. The downhole pump assembly as claimed in claim 9, wherein the downhole pump assembly is adapted to be coupled directly to downhole tubing for supplying turbine drive fluid to the downhole pump assembly, and wherein the downhole pump assembly is adapted to recover well fluid through an annulus defined between a borehole in which the downhole pump assembly is located and the downhole pump assembly.

17. The downhole pump assembly as claimed in claim 13, wherein the delivery tubing extends to surface.

18. A downhole pump assembly comprising a turbine and a pump, the turbine being coupled to the pump for driving the pump, and wherein the turbine is a radial flow turbine, wherein the downhole pump assembly is adapted to be coupled directly to downhole tubing for supplying turbine drive fluid to the assembly, and wherein the assembly is adapted to recover well fluid through an annulus defined between a borehole in which the assembly is located and the assembly, further comprising discharge tubing extending through the turbine and the pump to a discharge location spaced from the assembly.

19. A downhole pump assembly comprising a turbine and a pump, the turbine being coupled to the pump for driving the pump, and wherein the turbine is a radial flow turbine, wherein the turbine, in use, drive fluid entering a chamber from a supply passage via nozzle means impacts turbine blade means, the drive fluid exhausting from the chamber via outlet apertures angularly spaced from the nozzle means in a downstream direction and into exhaust passages.

20. The downhole pump assembly as claimed in claim 19, wherein the turbine blade means are, in use, driven by radial flow of the drive fluid, and wherein the pump is adapted to pump well fluid uphole so as to recover well fluid to surface, wherein the rotational velocity of the turbine is adjustable to balance the rotational velocity of the turbine with a rotational velocity of the pump.

21. A downhole pump assembly comprising a turbine and a pump, the turbine being coupled to the pump for driving the pump, and wherein the turbine is a radial flow turbine, wherein the turbine comprises a tubular casing enclosing a chamber having rotatably mounted therein a rotor comprising enclosing a chamber having rotatably mounted therein a rotor comprising at least one turbine wheel blade array with an annular array of angularly distributed blades orientated with drive fluid receiving faces thereof facing generally rearwardly of a forward direction of rotation of the rotor, and a generally axially extending inner drive fluid passage generally radially inwardly of said rotor, said casing having a generally axially extending outer drive fluid passage, one of said inner and outer drive fluid passages constituting a drive fluid supply passage and being provided with at least one outlet nozzle formed and arranged for directing at least one jet of drive fluid onto said blade drive fluid receiving faces of said at least one blade array as said blades traverse said nozzle for imparting rotary drive to said rotor, the other constituting a drive fluid exhaust passage and being provided with at least one exhaust aperture for exhausting drive fluid from said at least one turbine wheel blade array.

22. A downhole pump assembly comprising a turbine and a pump, the turbine being coupled to the pump for driving the pump, and wherein the turbine is a radial flow turbine, wherein the turbine comprises a tubular casing enclosing a chamber having rotatably mounted therein a rotor having at least two turbine wheel blade arrays each with an annular array of angularly distributed blades orientated with drive fluid receiving faces thereof facing generally rearwardly of a forward direction of rotation of the rotor, and a generally axially extending inner drive fluid passage generally radially inwardly of each said turbine wheel blade array, said casing having a respective generally axially extending outer drive fluid passage associated with each said turbine wheel blade array, one of said inner and outer drive fluid passages constituting a drive fluid supply passage and being provided with at least one outlet nozzle formed and arranged for directing at least one jet of drive fluid onto said blade drive fluid receiving faces as said blades traverse said at least one nozzle for imparting rotary drive to said rotor, the other constituting a drive fluid exhaust passage and being provided with at least one exhaust aperture for exhausting drive fluid from said turbine wheel blade arrays, neighbouring turbine wheel blade arrays being axially spaced apart from each other and provided with drive fluid return flow passages therebetween connecting the exhaust passage of an upstream turbine wheel blade array to the supply passage of a downstream turbine wheel blade array for serial interconnection of said turbine wheel blade arrays.

23. A downhole pump assembly comprising a turbine and a pump, the turbine being coupled to the pump for driving the pump, and wherein the turbine is a radial flow turbine, wherein the rotational velocity of the turbine is adjustable to balance the rotational velocity of the turbine with that of the pump, wherein the size of a nozzle of the turbine is adjustable to vary the rotational velocity of the turbine, to balance the rotational velocity of the turbine to that of the pump.

24. The downhole pump assembly as claimed in claim 23, wherein the pump is adapted to pump well fluid uphole so as to recover well fluid to surface, and wherein the turbine is adapted to be driven at least in part by recovered well fluid.

25. An assembly as claimed in claim 24, wherein the turbine is adapted to be driven at least in part by water separated from the recovered well fluid.

26. An assembly as claimed in claim 24, wherein the turbine is adapted to be driven at least in part by oil separated from the recovered well fluid.

27. A downhole pump assembly comprising a turbine and a pump, the turbine being coupled to the pump for driving the pump, and wherein the turbine is a radial flow turbine, wherein the turbine includes a fluid outlet isolated from a fluid outlet of the pump, wherein the turbine fluid outlet is spaced from the pump for discharging turbine drive fluid at a location spaced from the pump, and wherein the turbine fluid outlet is located, in use, further downhole than the pump fluid outlet;

wherein the pump is adapted to pump well fluid uphole so as to recover well fluid to surface; and wherein a fluid outlet of the pump is disposed in fluid communication with a fluid outlet of the turbine.

28. A method of recovering well fluids, the method comprising:

coupling a turbine to a pump to form a downhole pump assembly, the downhole assembly comprising the turbine and the pump, wherein the turbine is a radial flow turbine, wherein the turbine includes a fluid outlet isolated from a fluid outlet of the pump, wherein the turbine fluid outlet is spaced from the pump for discharging turbine drive fluid at a location spaced from the pump, and wherein the turbine fluid outlet is located, in use, further downhole than the pump fluid outlet, and the pump being adapted to pump well fluid uphole so as to recover well fluid to surface; and coupling the downhole pump assembly to downhole tubing;

running the downhole tubing and downhole pump assembly into a borehole of a well and locating the pump assembly in a region of a well fluid producing formation; and supplying drive fluid downhole to drive the turbine, to in turn drive the pump and recover well fluid from the borehole, the method further comprising:

coupling the turbine directly to production tubing and supplying drive fluid through the production tubing to drive the turbine, and recovering well fluid through an annulus defined between the downhole pump assembly and the borehole.

29. A method of recovering well fluids, the method comprising:

coupling a turbine to a pump to form a downhole pump assembly, the downhole assembly comprising the turbine and the pump, wherein the turbine is a radial flow turbine, wherein the turbine includes a fluid outlet isolated from a fluid outlet of the pump, wherein the turbine fluid outlet is spaced from the pump for discharging turbine drive fluid at a location spaced from the pump, and wherein the turbine fluid outlet is located, in use, further downhole than the pump fluid outlet, and the pump is adapted to pump well fluid uphole so as to recover well fluid to surface;

coupling the downhole pump assembly to downhole tubing;

running the downhole tubing and downhole pump assembly into a borehole of a well and locating the pump assembly in a region of a well fluid producing formation;

supplying drive fluid downhole to drive the turbine, to in turn drive the pump and recover well fluid from the borehole; and mixing well fluid with turbine drive fluid discharged from the turbine in the region of an outlet of the pump and returning the well fluid to surface.

30. The method as claimed in claim 29, further comprising injecting spent turbine drive fluid into the formation.

31. The method as claimed in claim 30 comprising coupling discharge means to the downhole pump assembly defining a turbine outlet and isolating the turbine outlet from the pump, to inject spent drive fluid into the formation.

32. The method as claimed in claim 30, comprising injecting spent turbine drive fluid into the formation at a location spaced from the downhole pump assembly.

33. The method as claimed in claim 30, comprising supplying drive fluid at least partly comprising recovered well fluid to the turbine to drive the turbine.

34. The method as claimed in claim 33, comprising supplying drive fluid at least partly comprising recovered water.

35. The method as claimed in claim 33, comprising supplying drive fluid at least partly comprising recovered oil.

36. The method as claimed in claim 33, comprising separating recovered well fluid into at least water and oil components and supplying the separated water to the turbine to drive the turbine.

37. The method as claimed in claim 29, comprising supplying drive fluid at least partly comprising a gas to the turbine to drive the turbine.

38. The method as claimed in claim 29, comprising supplying drive fluid at least partly comprising steam to the turbine to drive the turbine.

39. A method of recovering well fluids, the method comprising:

coupling a turbine to a pump to form a downhole pump assembly, the downhole assembly comprising the turbine and the pump, wherein the turbine is a radial flow turbine, wherein the turbine includes a fluid outlet isolated from a fluid outlet of the pump, wherein the turbine fluid outlet is spaced from the pump for discharging turbine drive fluid at a location spaced from the pump and wherein the turbine fluid outlet is located, in use, further downhole than the pump fluid outlet, and the pump is adapted to pump well fluid uphole so as to recover well fluid to surface;

coupling the downhole pump assembly to downhole tubing;

running the downhole tubing and downhole pump assembly into a borehole of a well and locating the pump assembly in a region of a well fluid producing formation;

supplying drive fluid downhole to drive the turbine, to in turn drive the pump and recover well fluid from the borehole; and balancing the operational velocity of the turbine to that of the pump.

40. A method of recovering well fluids, the method comprising:

coupling a turbine to a pump to form a downhole pump assembly, the downhole assembly comprising the turbine and the pump, the turbine being coupled to the pump for driving the pump, and wherein the turbine is a radial flow turbine, wherein the turbine includes a fluid outlet isolated from a fluid outlet of the pump, wherein the turbine fluid outlet is spaced from the pump for discharging turbine drive fluid at a location spaced from the pump, and wherein the turbine fluid outlet is located, in use, further downhole than the pump fluid outlet; and coupling the downhole pump assembly to downhole tubing;

running the downhole tubing and downhole pump assembly into a borehole of a well and locating the pump assembly in a region of a well fluid producing formation; and supplying drive fluid downhole to drive the turbine, to in turn drive the pump and recover well fluid from the borehole;

further comprising balancing the operational velocity of the turbine to that of the pump; and adjusting the size of an outlet nozzle of the turbine formed and arranged for directing at least one jet of drive fluid onto a turbine blade array of the turbine to vary the flow velocity of fluid through the turbine.

* * * * *